United States Patent [19]

Kerner

[11] Patent Number: 4,807,671

[45] Date of Patent: Feb. 28, 1989

[54] GUIDE MECHANISM FOR A WEFT THREAD INSERTING GRIPPER ROD IN SHUTTLELESS LOOMS

[75] Inventor: Horst Kerner, Lindenberg, Fed. Rep. of Germany

[73] Assignee: Lindauer Dornier Gesellschaft mbH, Lindau, Fed. Rep. of Germany

[21] Appl. No.: 152,312

[22] Filed: Feb. 3, 1988

[30] Foreign Application Priority Data

Feb. 4, 1987 [DE] Fed. Rep. of Germany ..... 3703316

[51] Int. Cl.[4] ..... D03D 47/00

[52] U.S. Cl. ..... 139/449

[58] Field of Search ..... 139/441, 444, 445, 446, 139/449

[56] References Cited

U.S. PATENT DOCUMENTS

| | | | |
|---|---|---|---|
| 733,586 | 7/1903 | Hutchins | 139/449 |
| 1,734,091 | 11/1929 | Holmes | 139/449 |
| 3,364,954 | 1/1968 | Kokkinis | 139/449 |
| 3,999,580 | 12/1976 | Sparling | 139/449 |
| 4,188,980 | 2/1980 | Muller | 139/449 |

FOREIGN PATENT DOCUMENTS 3149778 12/1983 Fed. Rep. of Germany .

*Primary Examiner*—Henry S. Jaudon

*Attorney, Agent, or Firm*—W. G. Fasse; D. H. Kane, Jr.

[57] ABSTRACT

A guide mechanism for a weft thread inserting gripper rod in shuttleless looms, has upwardly open U-rail mounted in a gripper rod housing for guiding at least a portion of the reciprocating gripper rod in the housing. Additionally, guide rollers position adjustably mounted in a bracket are located in an operating position for guiding the gripper rod outside the gripper rod housing. The bracket is either tiltably or removably mounted to the loom frame for bringing the guide rollers into an inoperative position in which the gripper rod is easily accessible for disengagement from its drive sprocket and removal out of the gripper rod housing. The guiding by the U-rail and by the guide rollers effectively prevents gripper rod vibrations, yet permits an easy access to the gripper rod.

7 Claims, 2 Drawing Sheets

1
1a
2
3
4
5
6
6'
6a
7
8
9
10
11a
11a'
11b
11c
11d
11d'
12a
12b 1
2a
3
6
7
10
10a
10b
10c
11a
11b
11b'
11c
11c'
11d
11d'
12a
12b
A

GUIDE MECHANISM FOR A WEFT THREAD INSERTING GRIPPER ROD IN SHUTTLELESS LOOMS

FIELD OF THE INVENTION

The invention relates to a guide mechanism for a weft thread inserting gripper rod in shuttleless looms. More specifically, the invention relates to guiding gripper rods which are equipped with a toothed rack for engagement by a drive pinion or sprocket for moving the gripper rod back and forth in the loom shed of a shuttleless loom.

DESCRIPTION OF THE PRIOR ART

It is known to guide the gripper rods near the location where the drive sprocket engages the toothed rack. Freely rotatable guide rollers are mounted in positions for engaging sides of the gripper rod. It is also known to protect the gripper rod particularly its end pointing away from the loom shed in a gripper rod protecting housing.

Generally, it was customary heretofore to let the rear end of the gripper rod, namely the end pointing away from the loom shed to move freely back and forth in the gripper rod housing or to let the downwardly facing surface or side of the gripper rod engage a running surface inside the protective housing. The guiding of the gripper rod took place exclusively at the location near the drive mechanism where the sprocket or pinion engages the toothed rack of the gripper rod. Thus, it has been unavoidable heretofore that gripper rod vibrations occurred, especially when rapid gripper rod movements are performed. Particularly, the rear end of the gripper rod would tend to vibrate and that in different directions.

German Pat. No. (DE-PS) 3,149,778 discloses a weft thread inserting mechanism in which such vibrations have been avoided to a substantial extent with the aid of a guide surface located inside the tubular gripper rod protecting housing, and forming part of the rear end of the gripper rod. This guide surface is either formed by a cylindrical ring that is supported by radial support members inside the protecting housing. Alternately, the guide surface can comprise a plurality of individual guide surface sections. It has been possible to reduce the tendency of the gripper rod to vibrate to such an extent that the construction of the drive and guide block could be simplified due to the above mentioned guide surface of the gripper rod in the protecting housing. However, the known vibration preventing arrangement has a substantial disadvantage because the gripper rod with its guide inside the protective housing cannot easily be removed from or installed in its protective housing for maintenance purposes. The reason for this difficulty is not only caused by the roller guide means at the driving location, but also by the special piston type by guiding at the end of the gripper rod. Thus, in the conventional device it is necessary to pull the gripper rod to a substantial extent out of the protective housing in order to be able to disengage the gripper rod from its driving sprocket. As a result of this substantial extension of the gripper rod out of its protective housing, it is easy to cant the gripper rod, thereby bringing the guide surface or the guide piston out of alignment inside the protective housing. Another disadvantage in this operation is the fact that the gripper rod needs to reach all the way into the loom shed which hinders its complete removal from its protective housing.

OBJECTS OF THE INVENTION

In view of the foregoing it is the aim of the invention to achieve the following objects singly or in combination:

to improve the guiding of a weft thread inserting gripper rod, the rear end of which travels back and forth in a protecting housing, in such a way that any tendencies to vibrate inside the protecting housing are avoided while simultaneously an easy access is provided to the gripper rod for an easy installation or removal of the gripper rod for maintenance purposes;

to provide and mount the guiding means for the gripper rod in such a way that the gripper rod can be tilted upwardly for disengagement from its driving means, whereby pulling the gripper rod horizontally all the way into the loom shed for said disengagement is avoided; and to mount the guide rollers in such a way to a bracket that a single bracket can carry a plurality of guide rollers engaging the gripper rod on several sides, preferably three sides.

SUMMARY OF THE INVENTION

According to the invention the above objects have been achieved by the arrangement of a guide rail having an upwardly open U-cross-sectional configuration in the protecting housing so that the rear end of the gripper rod can move back and forth in the U-guide rail, and in that a plurality of freely rotatable guide rollers supported by a holding member, such as a bracket, can be brought into an operative position and removed into an inoperative position so that the gripper rod can be tilted upwardly for disengagement with its driving mechanism such as a sprocket meshing with a toothed rack of the gripper rod.

Due to the upwardly open U-configuration of the guide rail, it is possible to properly guide the gripper rod along its entire length inside the protecting housing, whereby adverse vibrations of the gripper rod are prevented. Since the U-cross-section of the guide rail is open upwardly, it is possible without any difficulties to lift the gripper rod upwardly out of the guide rail. For the removal or installation of the gripper rod it is merely necessary to remove the guide rollers from their operating position in the area where the drive means engage the gripper rod. Thus, the mounting bracket for the guide rollers may either be secured to the loom frame by a screw or the like for an easy removal of the guide roller mounting bracket. In an alternative embodiment the mounting bracket may be hinged to the machine frame for tilting the mounting bracket with its guide rollers out of the way, either upwardly or in a lateral direction for moving the guide rollers out of the way. Removal of the hinge pin permits removing the mounting bracket altogether. In order to facilitate the installation or the removal, it is advantageous to mount the guide rollers on axle studs or bolts which are mounted eccentrically and adjustably in the bracket. Thus, the exact contact between the circumferental surfaces of the guide rollers with the respective side of the gripper rod can easily be adjusted by adjusting the position of these eccentric axle studs.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
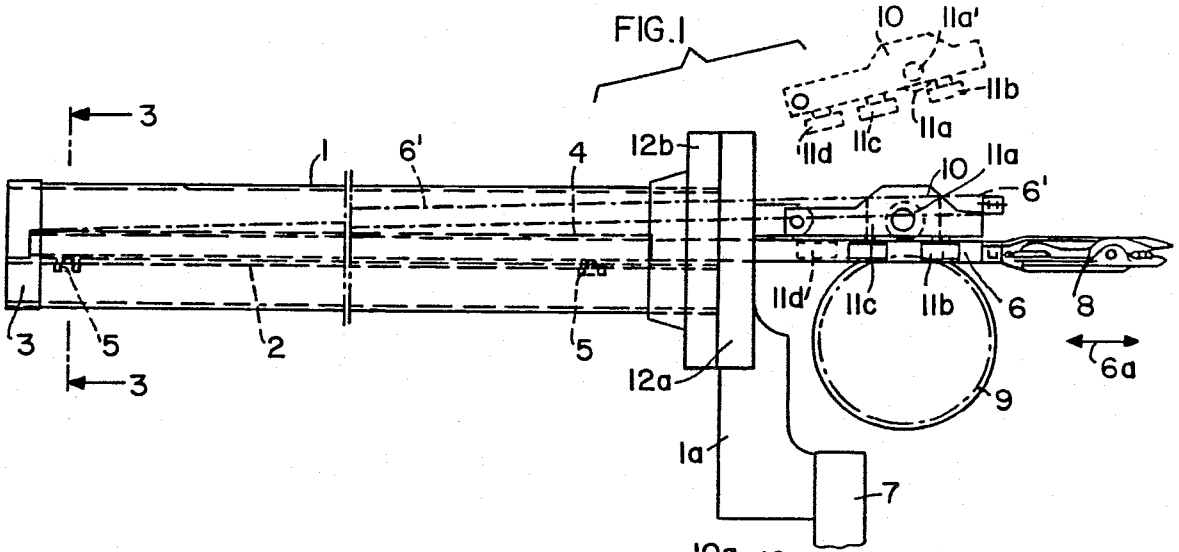
FIG. 1 is a side view of a gripper rod with its guide mechanism as viewed in the direction of the arrow A in FIG. 2.

Referring to FIG. 1, a protecting housing 1, for example in the form of a cylinder, is secured to a bracket 1a carrying a flange 12*a* and secured to a frame member 7 of the loom not shown. A flange 12*b* carrying the protecting housing 1 is secured to the flange 12*a* by conventional screws or the like. The length of the housing 1 is illustrated in a shortened manner to accommodate the illustration on a single drawing sheet.

A gripper rod 6 carrying a gripper head 8 is movable back and forth in the direction of the arrow 6a by a sprocket wheel 9 engaging a toothed rack portion of the gripper rod 6 as is conventional. The invention is not concerned with the driving of the gripper rod 6. Therefore, a more detailed description of the conventional driving features is not provided.

Figure 2:
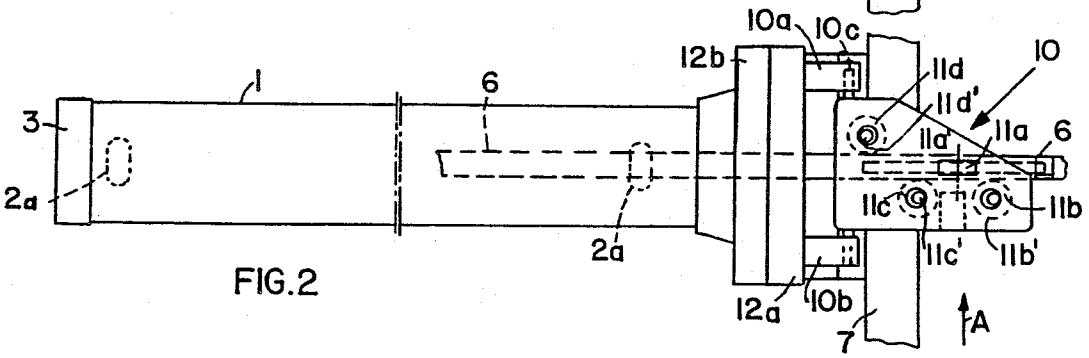
FIG. 2 is a top view on the mechanism shown in FIG. 1.

According to the invention a plurality of guide rollers 11*a*, 11*b*, 11*c*, and 11*d* are mounted for free rotation to a bracket 10 on respective eccentric axle studs 11*a*', 11*b*', 11*c*' and 11*d*', please see FIGS. 1 and 2 in conjunction. The guide roller 11*a* contacts, in the operative position of the bracket 10 as shown in full lines in FIG. 1, the upwardly facing side or surface of the gripper rod 6, that is the side opposite the side where the toothed rack engages the sprocket 9. The guide rollers 11*b* and 11*c* engage the gripper rod 6 on one lateral side while the guide roller 11*d* engages a lateral or side surface of the gripper rod 6 opposite to the guide rollers 11*b* and 11*c*. The inoperative position of the mounting bracket 10 with its guide rollers is shown in dashed lines in FIG. 1. The position is only relative and not to be taken on the basis of any scale.

Figure 3:
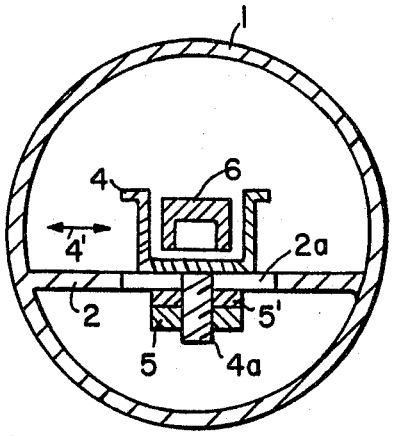
FIG. 3 is a sectional view along section line 3—3 in FIG. 1.

Inside the protecting housing 1 there is arranged a divider wall 2 extending approximately horizontally for carrying a U-cross-sectional guide rail 4 opening upwardly as best seen in FIG. 3 for receiving the inner end of the gripper rod 6 in the U-channel of the guide rail 4 to prevent vibrations. The position of the U-guide rail 4 on the wall 2 is adjustable horizontally back and forth as indicated by the arrow 4' in FIG. 3 for properly aligning the guide rail 4 with the gripper rod 6. For this purpose the wall 2 has elongated holes 2*a* extending horizontally and perpendicularly to the longitudinal axis of the housing 1. A bolt 4*a* connected to the guide rail 4 extends through each of these longitudinal holes 2*a* and the guide rail 4 is secured to the wall 2 by nuts 5 bearing through a washer 5', for example, against the sides of the holes 2*a*. When the nuts 5 are loosened, the guide rail 4 is adjustable. When the nuts 5 are tightened, the guide rail 4 is fixed.

The rear end of the housing 1 has a removable closure cap 3 which provides easy access for the adjustment of the nut 5 at the left end of the housing 1. Similarly, the right-hand end of the housing 1 may be provided with a cover member 1*a* in the wall of the housing 1 to provide access to the respective adjustment nut 5.

It has been found that the arrangement of the guide rail 4 provides such a satisfactory guiding of the gripper rod 6 that it is sufficient to utilize just two guide rollers at the driving location, namely the guide roller 10*a* bearing against the top surface of the gripper rod 6 and one of the side guide rollers. However, it is advantageous to use side guide rollers on opposite sides as shown in FIGS. 1 and 2. By providing the axle studs in the form of adjustable eccenter bolts 11*a*', 11*b*', 11*c*', and 11*d*' it is possible to adjust the position of each guide roller individually for proper contact with the respective gripper rod surface. This feature also facilitates the removal of the mounting bracket 10 by loosening the axle studs, thereby also facilitating the access to the gripper rod.

FIG. 1 also shows the gripper rod in a dashed line position when the bracket 10 is in its inoperable position. The bracket 10 is, for example, hinged to the flange 12*a* with the aid of hinging arms 10*a* and 10*b* and a preferably removable hinging bolt 10*c*. The hinging connection is preferably used when guide rollers are provided on each lateral side. If guide rollers are provided only on one side, it may be possible to hinge the bracket 10 for a lateral tilting movement. However, the mounting of the bracket 10 is not limited to a hinging connection. A simple screw connection may be sufficient which is easily released for removing the bracket with its guide rollers. In any of these mountings of the bracket 10 its removal out of the operative position into an inoperative position permits tilting the rod 6 into the dashed line position 6', thereby disengaging it from its drive sprocket 9 and permitting the easy removal, even if the rod 6 first is inside the housing 1 to the full extent. The lifting of the gripper rod into the dashed line position 6' is sufficient to withdraw the gripper rod from the housing 1 without moving the gripper rod into the loom shed. Thus, it is not even necessary to remove components from the loom shed or the like.

Although the invention has been described with reference to specific example embodiments, it will be appreciated, that it is intended to cover all modifications and equivalents within the scope of the appended claims.

What I claim is:

1. A guide mechanism for a weft thread inserting gripper rod for shuttleless looms, comprising housing means for protecting at least a portion of said gripper rod, a guide rail (4) having an upwardly open U-section mounted in said protecting housing means for receiving and guiding at least said portion of said gripper rod, freely rotatable guide roller means arranged for guiding said gripper rod in its back and forth movement, and mounting means for locating said guide roller means in an operative position for guiding said gripper rod in its back and forth movement, said mounting means permitting moving said guide roller means into an inoperative position in which said gripper rod is freely accessible.

2. The guide mechanism of claim 1, wherein said mounting means comprise a bracket and axle studs secured to said bracket in such locations that said guide roller means contact said gripper rod on a plurality of gripper rod sides when said bracket locates said guide roller means in said operative position.

3. The guide mechanism of claim 2, wherein said guide roller means comprise at least two guide rollers each having a rotational axis extending substantially vertically in said operative position, whereby said two guide rollers extend in a horizontal plane for contacting said gripper rod on opposite lateral gripper rod sides, said guide roller means further comprising at least one further guide roller having a rotational axis extending substantially horizontally in said operative position, whereby said further guide roller extends in a vertical plane for contacting said gripper rod on a top gripper rod side.

4. The guide mechanism of claim 2, wherein said axle studs for said guide roller means comprise position adjustable eccentric studs for adjusting said operative position of said guide roller means relative to said gripper rod.

5. The guide mechanism of claim 1, further comprising adjustment means for adjustably securing said guide rail in said tubular housing means relative to said gripper rod.

6. The guide mechanism of claim 2, wherein said mounting means further comprise hinging means for tiltably securing said bracket to said loom so that the bracket with its guide rollers can be tilted back and forth between said operative position and said inoperative position.

7. The guide mechanism of claim 6, wherein said hinging means comprise a withdrawable hinge pin for completely removing said bracket with its guide rollers from said operative position.

* * * * *